United States Patent [19]

Mikiya

[11] Patent Number: 4,632,190

[45] Date of Patent: Dec. 30, 1986

[54] PNEUMATICALLY-OPERATED MULTI-NEEDLE CHISEL TOOL

[76] Inventor: Toshio Mikiya, 9-17, Todoroki 1-chome, Setagaya-ku, Tokyo, Japan

[21] Appl. No.: 600,334

[22] Filed: Apr. 13, 1984

[30] Foreign Application Priority Data

Apr. 15, 1983 [JP] Japan ..... 58-55521[U]

[51] Int. Cl.[4] ..... B25D 9/00

[52] U.S. Cl. ..... 173/133; 173/51; 173/114; 29/81 D

[58] Field of Search ..... 173/51, 139, 101–103, 173/118–120, 138, 116, 115; 29/81 D, 81 R, 81 G, 81 L; 144/115; 30/164.6, 169; 92/85 B

[56] References Cited

U.S. PATENT DOCUMENTS

| | | | |
|---|---|---|---|
| 1,643,220 | 9/1927 | Metzner | 173/51 |
| 2,220,195 | 11/1940 | Amundson | 173/120 |
| 2,588,360 | 3/1952 | Cole | 173/122 |
| 2,779,085 | 1/1957 | Schoengarth | 29/81 D |
| 3,223,182 | 12/1965 | Mikiya | 173/114 |
| 3,344,868 | 10/1967 | Mikiya et al. | 173/114 |
| 3,680,643 | 8/1972 | Cameron et al. | 29/81 D |

FOREIGN PATENT DOCUMENTS 5867 3/1966 Japan .

*Primary Examiner*—Donald R. Schran
*Assistant Examiner*—James L. Wolfe
*Attorney, Agent, or Firm*—Birch, Stewart, Kolasch & Birch

[57] ABSTRACT

A pneumatically-actuated multi-needle type chisel tool is provided having a hollow cylinder body, a piston ram fitted for axially reciprocal movement in a rearward portion of the cylinder body, an anvil fitted for axially reciprocal movement in an intermediate portion of the cylinder body, a needle holder fitted for axially reciprocal movement in a forward portion of the cylinder body and a number of needle chisels journaled for axially reciprocal movement in the needle holder. A first air passage is provided with an opening into the rearward portion of the cylinder body to introduce compressed air thereinto for moving the piston ram to and fro. A second air passage is provided with an opening into the forward portion of the cylinder body to introduce compressed air thereinto for moving the needle holder rearwardly. A cylinder cap is axially adjustably mounted to the forward portion of the cylinder body with the rear end face of the cap facing opposite to the outer peripheral forwardly facing surface of the needle holder such that the air pressure in the space of the cylinder body interior enclosed by the anvil and the needle holder is pressurized upon the anvil being rapidly moved forward by the impact from the piston ram, causing the pressurized air force to move the needle holder forwardly. Similarly, the air introduced into the forward portion of the cylinder body in front of the outer peripheral forwardly facing surface of the needle holder is compressed during the forward movement of the needle holder.

3 Claims, 4 Drawing Figures

PNEUMATICALLY-OPERATED MULTI-NEEDLE CHISEL TOOL

BACKGROUND OF THE INVENTION

Field of the Invention

This invention relates to a pneumatically-actuated multi-needle chisel tool for use in removing rust on a metal surface, weld splashes, foundry sand or the like, or chipping or grinding surfaces of stone material, concrete or the like by intensely reciprocating a multiplicity of needle chisels projecting from the forward end of the tool.

The chisel tool of the type described herein is known, as disclosed in Japanese Patent Application Publication No. 5867/1966 assigned to the same assignee as the present application, which comprises a cylinder for housing a main body of the tool, and a piston ram, an anvil and a needle holder carrying axially slidably multiple needle chisels, mounted for slidable reciprocating movement in the rearward, intermediate and forward sections, respectively within the cylinder. These components are moved to and fro by compressed air supplied as a motive fluid such that the piston ram is forced forward to strike the anvil which is in turn propelled forward to impact against the rear ends of the needle chisels, whereby the chisels are repeatedly reciprocated for impact against a workpiece such as metal, stone material or the like to perform the chipping or grinding operation or the workpiece.

With the prior art tool of this type, heavy impact forces are very smoothly developed to provide satisfactory chipping action by needle chisels which are intensely impacted on by the anvil which is struck by the piston ram with quick propelling power. However, if desired impact forces were not provided or smooth driving were impeded for some reason or other, it would ultimately exert adverse effects on the inner wall of the cylinder and the movable parts with the result that damages would be caused on the various parts such as the wall of the chisel bearing holes in the needle holder and the rear end heads of the needle chisels.

It has been found through research by the present inventor that the cause of such undesirable phenomenon is delicate discrepancy in the operational timing between the various components such as the piston ram, anvil, needle holder and needle chisels.

By way of example, if the anvil were not returned to the proper position for receiving maximum impact force from the piston ram at the point of time when the anvil is struck by the piston ram, desired impact force would not be transmitted to the anvil. Further, if the needle chisels were not in position ready for forward movement at the point of time when the needle chisels are struck by the anvil, the impact forces by the anvil would not effectively be transmitted to the needle chisels. Particularly, if the velocities of the needle holder during its forward and rearward movements were slower than those of the needle chisels, the needle holder would be impedimental to the advancement of the chisels during their forward movement. In that case the needle chisels may sometimes move forward in unison with the needle holder with the rear end heads of the chisels sticking to the rear end of the holder, so that the required impact forces are significantly lost. The arrangement is such that during the rearward movement of the needle holder the needle chisels are retracted together with the holder and that after the holder is stopped the needle chisels continue to further retract to a predetermined position by their inertia. However, if the repulsive force for retracting the needle holder were not sufficient, on one hand there would not be sufficient inertia developed to retract the needle chisels to the desired position away from the rear end of the holder while on the other hand it would become impossible to retract the anvil to its most effective position for impact by the piston rearwardmost position. Consequently, the desired stroke could not be imparted to the needle chisels upon being struck by the anvil, resulting in reduction of the impact forces. Furthermore, if the anvil started its forward movement before the needle chisels had completed their retraction, that is, while the chisels were still in the course of rearward movement, unnecessarily great impact forces would be generated between the anvil and the chisels, resulting in increased vibration and damages to the parts. Thus, if the parts impacted against each other while they were moving in opposed directions, extraordinarily vast impact forces would be developed.

Such discrepancy in operational timings are caused by loosening or play between the various parts of the tool due to shocks which may occur during the use as well as during the manufacture and assembly of the tool. Additional causes are increased frictional forces of the needle holder, the needle chisels and the like caused by iron debris such as rusts, stone chips or the like which are incidental to chipping and grinding operations because of the environment where the tool is employed and which will inevitably enter into the forward portion of the cylinder of the tool.

With the prior art chisel tool, no consideration has been paid to the adjustability of the operational timing despite the fact that the coordination in the operational timing is of critical importance to the chisel tool of this type, as indicated hereinabove.

With this in mind the present invention has been developed. According to the present invention, the arrangement for establishing proper operational timings between the various components in a smooth manner, particularly with respect to the coordination between the needle holder and the chisels is such that the needle holder is instantly moved forward by means of pneumatic repulsive forces upon the anvil being quickly forced forward by impact power from the piston ram. When the needle holder is to be retracted, the air behind the rear end of the holder is allowed to rapidly expand to move the holder backward in an instant. As a consequence the needle chisels are caused to retract to the desired position by their inertia while the air pressure built up between the needle holder and the anvil causes the latter to rapidly retract to the desired position, whereby the smooth forward movement and proper impact power of the needle chisels is ultimately insured. In addition, the present invention provides means for ready and easy adjustment to correct any discrepancy in the operational timing and to vary the stroke of the needle chisels.

BRIEF DESCRIPTION OF THE DRAWINGS

The objects and advantages of the present invention will become more apparent from the following description taken with reference to the accompanying drawings illustrating the sequential operations of the pneumatically-actuated multi-needle type chisel tool according to an embodiment of the invention in a side elevational view thereof with the upper halves of the three movable parts-piston ram, anvil and needle holder shown in cross-section, in which.

DESCRIPTION OF THE PREFERRED EMBODIMENT

Figure 1:
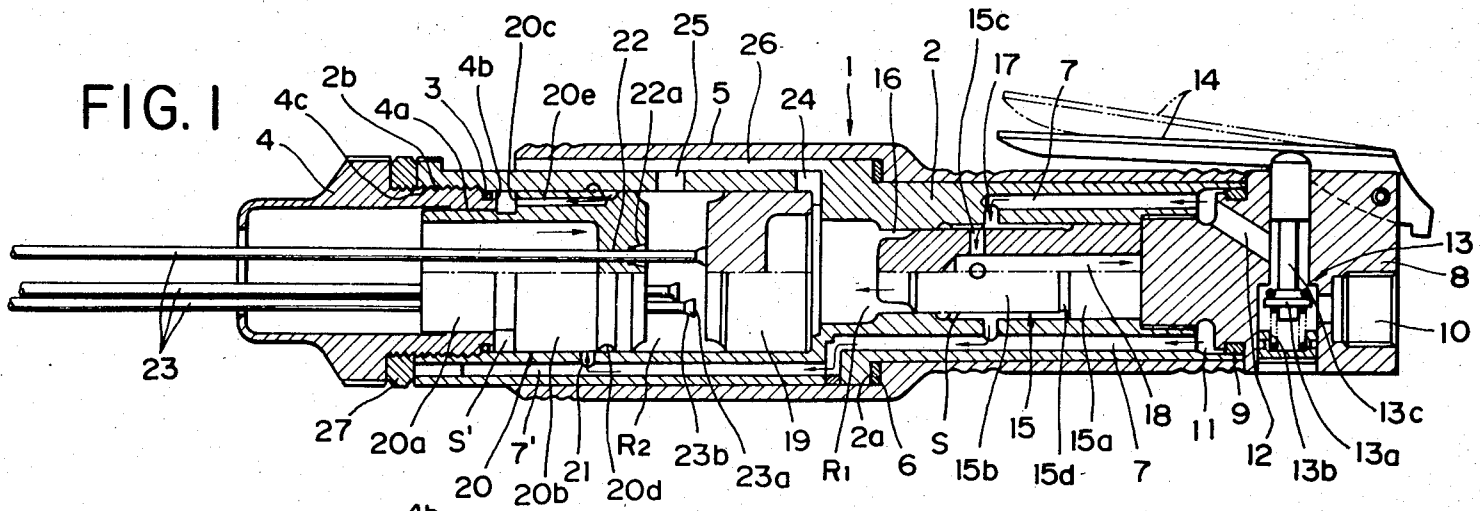
FIG. 1 shows the operator squeezing the operator lever.
Figure 2:
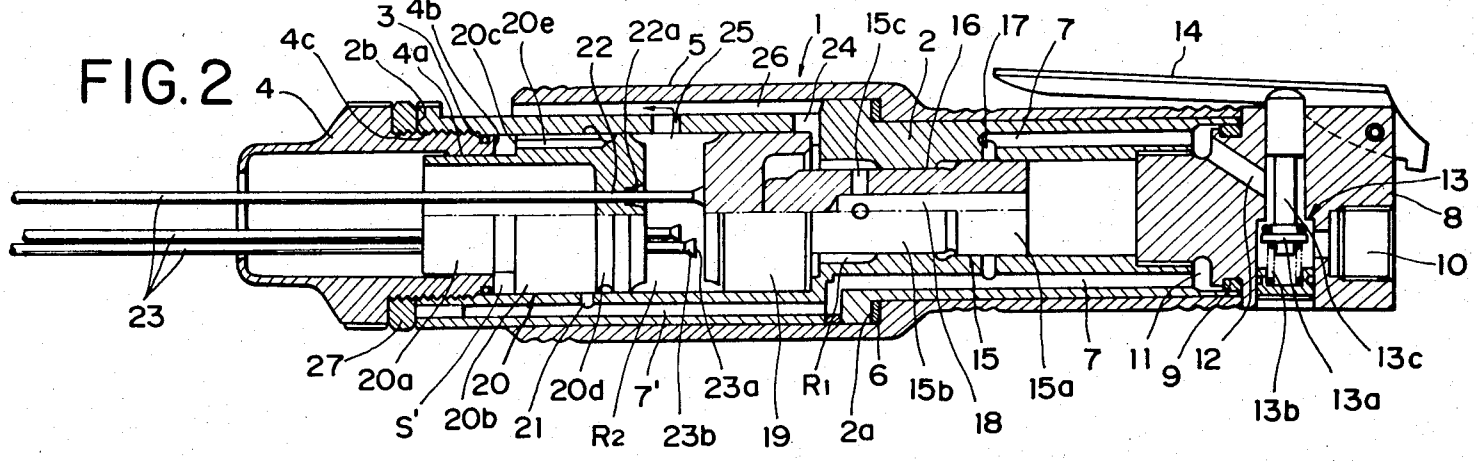
FIG. 2 shows the impact force being exerted on the anvil.

An embodiment of the pneumatically operated multi-needle type chisel tool will now be described with reference to FIGS. 1 to 4.

The chisel tool includes a tubular cylinder or housing 1 for the main body of the tool, said cylinder 1 comprising a longitudinal cylinder body 2 having central and forward enlarged diameter portions extending from a rear portion, and a cylinder cap 4 hermetically and axially adjustably secured to the forward portion of the cylinder body 2 with a seal ring 3 interposed therebetween.

A piston ram actuating chamber $R_1$ is defined in the rear portion of the cylinder body 2 while an anvil actuating chamber $R_2$ is defined in that part of the enlarged diameter portion extending from the central toward the forward portion of the cylinder body. A thermally insulating, antivibration cover 5 which may be made of plastic material surrounds the outer periphery of the cylinder body 2 with a resilient member 6 disposed between the periphery of the cylinder body and the cover 5 at the stepped portion 2*a*. Serially interconnected axially extending air supply passages 7 and 7′ are formed through the wall of the cylinder body 2 to supply the piston ram actuating chamber $R_1$ and anvil actuating chamber $R_2$.

A rear end member 8 is mounted to the open rear end of the cylinder body 2 in a gas-tight manner with a seal ring 9 interposed therebetween. The rear end member 8 has a channel 12 extending therethrough from a compressed air inlet 10 to an inner peripheral annular groove 11 for supplying compressed air to the air supply passage 7, and a control valve 13 for opening and closing the channel 12. The control valve 13 comprises a valve member 13*a* movable between its open and closed positions, a compression spring 13*b* normally urging the valve member to its closed position, and a valve stem 13*c* extending from the valve member through the rear end member 8 and projecting beyond the outer periphery of the end member into abutment with the underside of an operator handle 14 pivotally connected at one end to the rear end of the rear end member 8 and extending obliquely forwardly therefrom. In use, an operator may squeeze the lever 14 and the outer periphery of the cylinder body 2 adjacent its rear end to thereby depress the valve stem 13*c* and hence the valve member 13*a* to its open position. Upon the operator lever 14 being released, the compression spring 13*b* acts to raise the valve member 13*a* to thereby close the channel 12 while at the same time raising the valve stem 13*c* thereby restoring the lever 14 to its home position.

A piston ram 15 is axially slidably mounted for reciprocal movement within the piston ram actuating chamber $R_1$ closed by the rear end member 8. The piston ram 15 has an enlarged diameter rear end base 15*a* and a slightly reduced diameter slide portion 15*b* extending forward from the base which slide portion is slidably fitted in the reduced diameter guide portion 16 extending toward the forward end of the chamber $R_1$. Thus defined between the reduced diameter slide portion 15*b* and the wall of the chamber $R_1$ is an air space S which is filled with compressed air. Formed in the wall of the central portion of the chamber $R_1$ is a second inner peripheral groove 17 which is adapted to open into the space S except when the piston ram 15 is in its most forward position. The piston ram 15 has a central cylindrical cavity 18 axially extending from its rear end toward its forward end which cavity is supplied with compressed air through a number of radial air ports 15*c* formed through the reduced diameter slide portion 15*b* of the ram adjacent the forward end of said slide portion and through the annular groove 17 of the chamber $R_1$. Thus, upon compressed air being supplied when the space S and the annular groove 17 are in fluid communication with each other, the piston ram 15 is initially momentarily retracted under the pressure of compressed air acting on the stepped shoulder 15*d* of the enlarged base 15*a* of the ram, and then impulsively forced forward as the cavity 18 is pressurized through the air ports 15*c*.

Axially slidably mounted in the anvil actuating chamber $R_2$ of the enlarged diameter portion of the cylinder body on the side of the piston ram is an anvil 19 in the form of a disk-like metal block which is adapted to be struck by the piston ram 15. Axially slidably mounted in the chamber $R_2$ on the opposite side is a needle holder 20. The needle holder 20 has a slightly reduced diameter forward portion 20*a* which is slidably fitted in a reduced diameter rear end guide portion 4*a* of the cylinder cap 4, and an enlarged diameter rear portion 20*b*. An outer peripheral forwardly facing shoulder 20*c* between the forward and rear portion 20*a* and 20*b* is in opposed relation to the rear end face 4*b* so that an air space S′ is defined between the shoulder 20*c* and face 4*b*. In the illustrated embodiment, the needle holder 20 is of hollow cylindrical configuration open at its forward end but closed at its rear end by a rear end wall. Formed in the outer periphery of the enlarged diameter rearward base 20*b* adjacent its rear end is an outer annular groove 20*d* for compressed air the bottom of which is in fluid communication with an air channel 20*e* which is formed axially through the wall of the base 20*b* and intersects with the shoulder surface 20*c*. With this construction, when the outer peripheral annular groove 20*d* is brought into alignment with the inner annular groove 21 in communication with the air passage 7′ during the reciprocal movement of the needle holder 20, compressed air is admitted into the space S′ through the channel 20*e* to thereby retract the needle holder.

The adjustable cylinder cap serves to controllably prescribe for the volume of the space S′ by varying the position of the cap 4 threaded to the forward portion of the cylinder body, that is, by adjusting the rear end face 4*b* relative to the shoulder surface 20*c* so that the pressure as admitted into the space S′ during the forward movement of the needle holder 20 may be set at an appropriate value.

The needle holder 20 has a number of axial bearing holes 22 extending through its rear end wall for journalling needle chisels 23 therein for reciprocal movement. The enlarged rear end heads 23*a* of the chisels are in confronting relation with the front face of the anvil 19 so as to be struck by said front face. The heads 23*a* in the illustrated embodiment has a frusto-conical portion 23*b* tapering in a forward direction while the bearing holes 22 are formed at their rear end with complementarily frusto-conical recesses 22*a* for receiving the respective frusto-conical head portions 23*b* so that as the anvil 19 is propelled forward, the frusto-conical head portions 23*b* are smoothly brought into abutment with the rear end surface of the needle holder 20.

The side wall of the anvil actuating chamber $R_2$ in which the anvil 19 and needle holder 20 are mounted is formed with first air port means 24 at the rear end of the anvil and second air port means 25 between the anvil and the needle holder. Both of the air port means 24, 25 are in fluid communication with an air passage 26 defined between the wall of the chamber $R_2$ and the cover 5. The number and size of the second air port means 25 are such that the air in the space defined between the cylinder wall, anvil 19 and needle holder 20 is pressurized during either the forward movement of the anvil or the rearward movement of the needle holder so as to provide a high pressure air cushioning layer.

It is to be understood that any suitable means may be used within the scope of the invention to adjustably secure the cylinder cap 4 to the cylinder body. Preferably, as in the illustrated embodiment, the outer periphery of the rear end portion of the cylinder cap 4 is provided with inner screw threads 4*c* while the inner surface of the forward end portion of the cylinder body 2 is provided with complementary screw threads 2*b*. This arrangement is most convenient and capable of fine adjustment by varying the axial depth of the threaded engagement between the two threaded portions. A nut 27 threaded over the outer threaded portion 4*C* may be tightened against the forward end face of the cylinder body to lock the cylinder cap in its adjusted position.

The operation of the chisel tool constructed according to the principle of the present invention will now be described.

First, the operator squeezes the operator lever 14 in the position shown in the phantom line in FIG. 1 together with the rear end portion of the tool, whereby the control valve 13 is opened to introduce compressed air from a compressor (not shown) connected to the inlet 10 through the channel 12 in the rear end member and the inner annular groove 11 into the air passages 7, 7'. As the piston ram 15, anvil 19, needle holder 20 and needle chisels 23 are all freely slidable during the start-up of the tool, the piston ram 15 is retracted due to inclination or swinging movement of the tool, so that once the annular groove 17 is aligned with the space S, the piston ram is momentarily retracted to the most rearward position (FIG. 1) under the influence of the compressed air. At this time, as the needle holder 20 is moved slightly forward to bring the annular groove 20*d* into alignment with the annular groove 21 of the anvil actuating chamber $R_2$, compressed air is admitted through the channel 20*e* into the space S' defined between the outer peripheral forwardly facing shoulder surface 20*c* and the rear end face 4*b* of the cylinder cap to pressurize the space S' to provide a kind of high pressure air cushioning layer. The repulsive force due to this pressure build-up instantly retracts the needle holder 20 until the repulsive force is balanced primarily with the weight of the needle chisels 23 whereupon the holder 20 is stopped. It is to be noted that the needle holder 20 catches the needle chisels 23 by their enlarged head portions 23*a* and carries them with the holder in the course of retracting movement. However, the needle chisels continue to move rearward by their inertia toward the anvil 19 after the needle holder is stopped as described above (FIG. 2).

Since the rear end face 4*b* of the cylinder cap is appropriately positioned so as to promote expansion of the air as admitted into the space S', the needle holder 20 is very smoothly retracted by proper repulsive springy forces to thereby retract the needle chisels 23 to a position where the adequate stroke of the chisels is insured.

During this retraction of the needle holder 20 the air in that space of the cylinder body confined between the rear end face of the needle holder and the front face of the anvil is partially discharged through the air port means 25. However, the size of the air port means 25 is so selected, as indicated above, that the air in said space is pressurized to provide a kind of high pressure air cushioning layer whereby the needle holder 20 moves rearward without abutting against the anvil while the anvil is very smoothly retracted by the repulsive springy force of said air cushioning layer. The appropriate positioning of the rear end face 4*b* of the cylinder cap insures that the anvil 19 is moved rearward to the desired position. The adjustability in position of the cap 4 provides for correction of any discrepancy in the drive timing due to play between the various components resulting from misassembly, loosening of the components in use or wear of the needle holder by adjusting the stroke of the needle chisels to a predetermined distance and regulating the operational timing of the anvil, needle holder and needle chisels. Thus, even if the needle holder and the inner wall surface are worn out, adjustment may be made so that the anvil may be returned to its most rearward position (effective impacting position of the piston ram), and the stroke of the needle chisels which has become unstable may be adjusted to restore their chipping power.

Immediately after the start-up of the tool, compressed air is supplied through the air ports 15*C* to the cavity 18 in the piston ram 15 which has retracted to the predetermined position. An abrupt build-up in the interior pressure in the cavity 18 instantly forces the piston ram 15 forward to strike the anvil intensely. As the piston ram and the anvil are both at their proper positions with respect to the timing prior to the forward movement of the piston ram, the impulsive force of the ram is transmitted to the anvil 19 without any loss to propel the latter.

Figure 3:
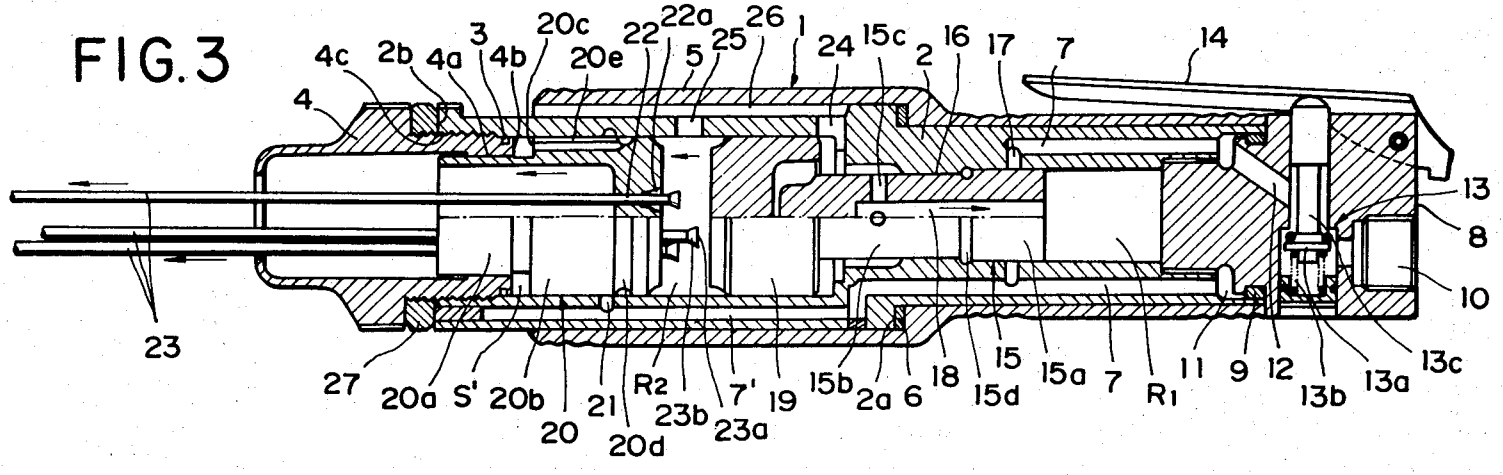
FIG. 3 shows the needle chisels being impacted on by the advancing anvil and the needle holder being moved forward by a high pressure air cushioning layer.
Figure 4:
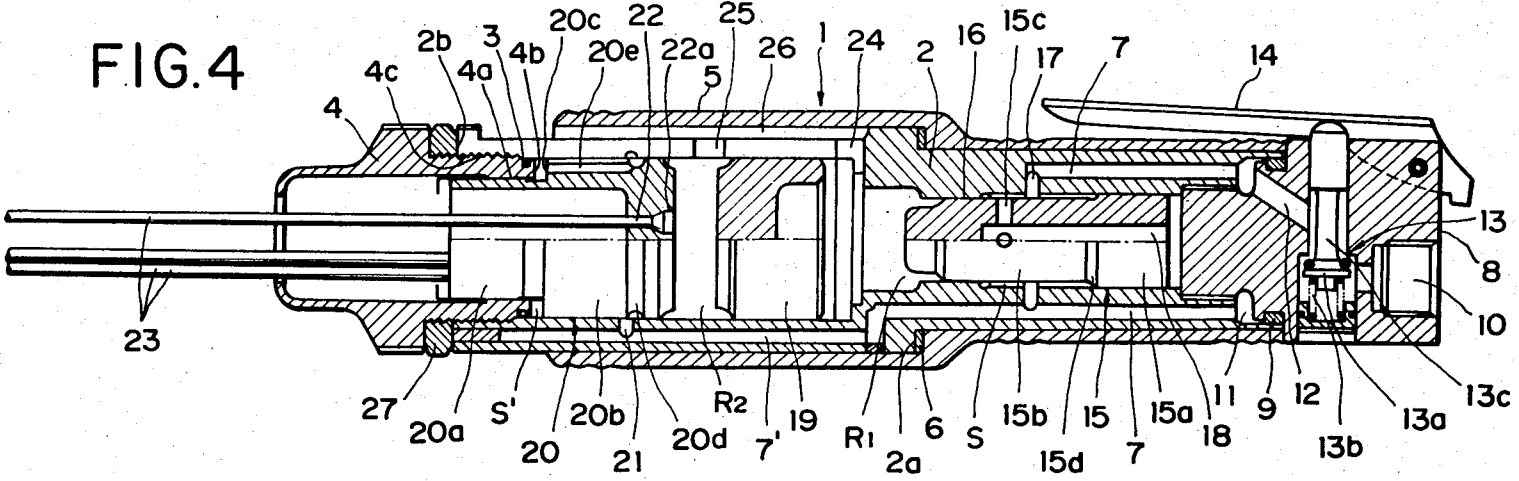
FIG. 4 shows the needle holder being moved to its forwardmost position.

The instant that the piston ram 15 hits the anvil 19 at the forward-most position of the ram, the cavity 18 in the ram is in communication with the atmosphere through the air ports 15*C* and the first air port means 24 of the ram actuating chamber $R_1$ so that the compressed air in the cavity is discharged to the atmosphere. Consequently, the piston ram 15 instantly begins retracting under reaction of impact, as shown in FIG. 3. As the space S comes into alignment with the annular groove 17 in the course of this retraction of the piston ram, the compressed air in said space acts on the piston ram to further move the latter rearward.

On the other hand, the anvil 19 being propelled forward strikes the enlarged heads 23*a* of the needle chisels 23 one after another to transmit the impact to their tips to cause the tips to remove the rust from a metal surface or to chip or grind the surface of a stone material. During the forward movement of the anvil 19 the air in the space confined between the front face of the anvil and the rear end face of the needle holder is partially discharged through the second air port means 25 as is the case during the rearward movement of the anvil. However, the size of the air port means is such that the air in said space is pressurized to provide a kind of high pressure air cushioning layer, so that the anvil 19 instantly forces the needle holder 20 forward by means of the high pressure air without directly hitting the needle holder to thereby propel the holder very smoothly. More specifically, the area of the rear end surface of the needle holder which is acted on by the air pressure is so large and the repulsive force of the air cushioning layer is so regulated that the needle holder 20 is moved forward at a higher speed than and ahead of the needle chisels 23 which were struck by the anvil and began to move forward earlier than the needle holder whereby the forward movement of the needle chisels is effected very smoothly without any loss of the impact force from the anvil and without undue load exerted on the bearing holes in the needle holder. Thus, there is no possibility that the enlarged heads 23*a* of the needle chisels may stick to the rear end surface of the needle holder. It is to be appreciated that if the needle holder is made of lighter reinforced plastic material it would further facilitate the forward movement of the needle holder.

During the forward movement of the needle holder 20 the outer peripheral forwardly facing shoulder surface 20*C* of the holder advances to reduce the space S' until the outer annular groove 20*d* in the holder comes into alignment with the inner annular groove 21 of the anvil actuating chamber $R_2$, whereupon compressed air is admitted from the air passage 7' into the space S' to form a kind of high pressure air cushioning layer therein, whereby the needle holder 20 is caused to reverse its movement toward the rearward direction by the repulsive force of the air cushioning layer before it collides with the rear end face 4*b* of the cylinder cap 4. The reversing of the movement is thus smoothly effected.

The needle chisels 23 are moved back and forth rapidly by the high speed repetition of the cycle as described above.

The pneumatically-operated multi-needle type chisel tool provides the following several functional advantages:

(A) Since the air in that portion of the interior of the cylinder body enclosed by the anvil and the needle holder is arranged to be pressurized to provide a kind of high pressure cushioning layer therein during the forward movement of the anvil and during the rearward movement of the needle holder, the instant responsive movements of the two components are effected while at the same time direct impact between the two components is avoided. As a consequence, particularly during the forward movement of the anvil, the needle holder advances ahead of the needle chisels which simultaneously move forward, so that the forward movement of the needle chisels which is critical to the effective operation of the tool may be smoothly carried out. Therefore, the walls of the bearing holes of the needle holder will not suffer damages. Further, the avoidance of direct contact between the anvil and the needle holder eliminates adverse effects on the components themselves, and reduces the vibration in operation, resulting in relieving the operator of his fatigue as well as enhancing the easiness in handling of the tool. It is also to be appreciated that the avoidance of direct impact contributes to preventing the loosening or play between the various parts, thereby facilitating maintenance of delicate balancing of the air pressures between the various air spaces, which leads to maintaining the proper operational timings permanently.

(B) The rear end face of the cylinder cap facing opposite to the outer peripheral forwardly facing shoulder surface of the needle holder is adjustably positioned so that the air introduced into the forward portion of the cylinder body is permitted to expand positively. The needle holder is thus caused to retract by the proper pneumatic repulsive force while direct impact between the rear end face of the cylinder cap and the needle holder is avoided. Consequently, it is insured that the needle holder and hence the anvil are moved backward to their predetermined appropriate positions to establish the desired effective stroke of the needle chisels. The strong impact power of the needle chisels which is critically important to the effective performance of the tool is thus obtained. That is, the operational timing of the needle chisels, and hence the operational timing of the entire tool may be optimized by appropriately adjusting the timing of retraction of the needle holder. Even if there occurred a discrepancy in the operational timings due to some cause or other such as an increase in frictional forces of the needle holder, needle chisels and the like which may be attributed to defectiveness in assembly, loosening or play between the various parts during the use, and ingress of iron dusts or sand generated during the chipping or grinding operation, the cylinder gap may be readjusted so as to maintain the compression of the air in the space S' at a predetermined level to thereby prevent the overshooting of the needle holder during its forward movement and adjust the stroke of the needle chisels, whereby the chipping power of the needle chisels may be increased.

What is claimed is:

1. A pneumatically actuated multi-needle type chisel tool comprising:

a hollow cylinder body;

a piston ram fitted for axially reciprocal movement in a rearward portion of said cylinder body;

an anvil fitted for axially reciprocal movement in an intermediate portion of the cylinder body, said anvil being positioned in front of said piston ram;

a needle holder fitted for axially reciprocal movement in a forward portion of the cylinder body, said needle holder being positioned in front of the anvil to define a first air space between a rear end face of the needle holder and a front end face of the anvil and having an outer peripheral forwardly facing shoulder surface;

a number of needle chisel journaled for axially reciprocal movement in said needle holder;

first air passage means formed in said cylinder body and opening into the rearward portion of the cylinder body to introduce compressed air thereinto for moving said piston ram to and fro;

second air passage means formed in said cylinder body and opening into the forward portion of the cylinder body to introduce compressed air thereinto for moving said needle holder rearwardly;

air port means formed through the wall of the cylinder body between the anvil and the needle holder for communicating said first air space with the atomosphere, said air port means being sized such that the air in said first air space is pressurized upon the anvil being rapidly moved forward by the impact from the piston ram, causing said pressurized air force to move the needle holder forwardly while preventing the anvil from direct impact on the needle holder and that the air in said first air space is also pressurized upon the needle holder being moved rearwardly to prevent the needle holder from direct impact on the anvil; and a cylinder cap axially adjustably mounted to the forward portion of said cylinder body with a rear end face of said cap facing opposite to and spaced from the outer peripheral forwardly facing shoulder surface of the needle holder to define a second air space between the rear end face of said cap and the forwardly facing shoulder surface of the needle holder such that the air introduced into said second air space through said second air passage means during the forward movement of the needle holder is pressurized to prevent said shoulder surface from coming into abutment with the rear end face of the cap;

whereby the forward movement of the needle holder and the rearward movement of the anvil are effected only by the repulsive expanding power of the air generated between the holder and the anvil and the timing of retraction of the needle chisels is adjustable by varying the position of the cylinder cap relative to the forward portion of the cylinder body.

2. A pneumatically-actuated multi-needle type chisel tool according to claim 1, wherein said piston ram includes a cavity and a passage, said passage being operatively connected between said cavity and said first air passage means for initially supplying compressed air to said cavity for imparting movement to said piston ram.

3. A pneumatically-actuated multi-needle type chisel tool according to claim 2, wherein said cylinder body includes a second air port means in communication with the atmosphere for venting said cavity through said passage when said piston ram is in a forward anvil engaging position.

* * * * *